US008104795B2

(12) United States Patent
Wilen

(10) Patent No.: US 8,104,795 B2
(45) Date of Patent: Jan. 31, 2012

(54) EXPANDABLE CARD FORM

(75) Inventor: Richard Wilen, Boca Raton, FL (US)

(73) Assignee: WILopEN Products, LC, Deerfield Beach, FL (US)

( * ) Notice: Subject to any disclaimer, the term of this patent is extended or adjusted under 35 U.S.C. 154(b) by 0 days.

(21) Appl. No.: 12/768,671

(22) Filed: Apr. 27, 2010

(65) Prior Publication Data

US 2010/0269380 A1 Oct. 28, 2010

Related U.S. Application Data

(63) Continuation-in-part of application No. 11/365,071, filed on Feb. 28, 2006, now Pat. No. 7,703,808.

(51) Int. Cl.
*B42D 5/00* (2006.01)

(52) U.S. Cl. ..... 281/15.1; 281/5; 283/56; 229/67.3

(58) Field of Classification Search ..... 281/2, 5, 281/15.1, 3.1, 45, 46; 283/34, 56, 61, 62, 283/63.1, 75; 229/67.1, 67.3, 68.1, 70, 92.1, 229/92.8; 434/150; 150/131, 147, 148
See application file for complete search history.

(56) References Cited

U.S. PATENT DOCUMENTS

| | | | | |
|---|---|---|---|---|
| 498,761 | A | 6/1893 | Becker | |
| 2,504,277 | A | 4/1950 | Otterson | |
| 3,141,549 | A * | 7/1964 | Koehler | 206/232 |
| 4,103,820 | A | 8/1978 | Mathison | |
| 4,195,864 | A | 4/1980 | Morton | |
| 4,441,270 | A * | 4/1984 | Crowell et al. | 283/56 |
| 4,733,856 | A | 3/1988 | Gunther | |
| 5,133,496 | A | 7/1992 | Davidson | |
| 5,377,904 | A | 1/1995 | Michlin | |
| 5,437,478 | A | 8/1995 | Gaines | |
| 5,870,718 | A | 2/1999 | Spector | |
| 6,315,206 | B1 | 11/2001 | Hansen | |
| 6,330,544 | B1 | 12/2001 | Walker | |
| 6,470,608 | B1 | 10/2002 | Edwards | |
| 6,493,970 | B1 | 12/2002 | McCarthy | |
| 6,601,755 | B2 | 8/2003 | Gillespie | |
| 6,725,587 | B2 | 4/2004 | Collins | |
| 6,732,459 | B1 | 5/2004 | Clark | |
| 6,746,052 | B1 * | 6/2004 | Reynolds | 283/34 |

(Continued)

FOREIGN PATENT DOCUMENTS

| | | |
|---|---|---|
| EP | 0695649 | 2/1996 |

(Continued)

*Primary Examiner* — Dana Ross
*Assistant Examiner* — Pradeep C Battula
(74) *Attorney, Agent, or Firm* — James David Johnson, PA; James David Johnson

(57) ABSTRACT

An expandable card form is described that includes a plurality of foldable leafs that are foldable onto one another at fold lines which separate each adjacent pair of foldable leafs. A slot can be cut through the fold line separating one of the adjacent pairs of foldable leafs. The plurality of foldable leafs can be connected to one another linearly and can include adhesive sections so that, when assembled, the foldable leafs form an expandable card. One end leaf can include a projecting panel attached thereto. The projecting panel can be extended through the slot when the card is expanded and can be retracted so as not to be visible when the card is oriented into its closed configuration. The expandable card can include information printed thereon to create a business card, a place setting card, a medical information card, or a gift card.

7 Claims, 8 Drawing Sheets

U.S. PATENT DOCUMENTS

| | | | |
|---|---|---|---|
| 6,754,636 | B1 | 6/2004 | Walker |
| 6,922,673 | B2 | 7/2005 | Karas |
| 7,188,762 | B2 | 3/2007 | Goade |
| 7,204,048 | B2 | 4/2007 | Kershner |
| 7,209,889 | B1 | 4/2007 | Whitfield |
| 7,303,121 | B2 | 12/2007 | Martinez |
| 7,315,828 | B1 | 1/2008 | McCarthy |
| 2003/0130907 | A1 | 7/2003 | Karas |
| 2003/0150141 | A1 | 8/2003 | Waldron |
| 2003/0150142 | A1 | 8/2003 | Street |
| 2004/0046035 | A1 | 3/2004 | Davila |
| 2004/0099730 | A1 | 5/2004 | Tuchler |
| 2004/0139318 | A1 | 7/2004 | Fiala |
| 2004/0205138 | A1 | 10/2004 | Friedman |
| 2004/0254833 | A1 | 12/2004 | Algiene |
| 2005/0229450 | A1 | 10/2005 | Larsen |
| 2005/0263587 | A1 | 12/2005 | Martinez |
| 2005/0275870 | A1 | 12/2005 | Elarde |
| 2006/0000127 | A1 | 1/2006 | Schindele |
| 2006/0186196 | A1 | 8/2006 | Schultz |
| 2006/0200362 | A1 | 9/2006 | Paciolla |
| 2006/0224452 | A1 | 10/2006 | Ng |
| 2006/0255154 | A1 | 11/2006 | Newbrough |
| 2006/0266665 | A1 | 11/2006 | Clarke |
| 2006/0273153 | A1 | 12/2006 | Ashby |
| 2007/0017973 | A1 | 1/2007 | Blank et al. |
| 2007/0157021 | A1 | 7/2007 | Whitfield |
| 2007/0168863 | A1 | 7/2007 | Blattner |
| 2007/0182155 | A1 | 8/2007 | Duffy |
| 2007/0187487 | A1 | 8/2007 | Wilen |
| 2007/0192784 | A1 | 8/2007 | Postrel |
| 2007/0288340 | A1 | 12/2007 | Kravitz |
| 2008/0195460 | A1 | 8/2008 | Varghese |
| 2008/0208745 | A1 | 8/2008 | Friedman |
| 2008/0294977 | A1 | 11/2008 | Friedman |
| 2009/0063297 | A1 | 3/2009 | Dooley |
| 2009/0222367 | A1 | 9/2009 | Jenkins |
| 2009/0283594 | A1 | 11/2009 | Walton |
| 2010/0017278 | A1 | 1/2010 | Wilen |
| 2010/0314276 | A1 | 12/2010 | Wilen |
| 2011/0025037 | A1 | 2/2011 | Wilen |
| 2011/0124390 | A1 | 5/2011 | Wilen |
| 2011/0125607 | A1 | 5/2011 | Wilen |

FOREIGN PATENT DOCUMENTS

| | | |
|---|---|---|
| GB | 2285412 | 7/1995 |
| WO | 0167364 | 9/2001 |
| WO | 2007092057 | 8/2007 |
| WO | 2010132575 | 11/2010 |
| WO | 2011026123 | 3/2011 |

* cited by examiner

EXPANDABLE CARD FORM

CROSS-REFERENCE TO RELATED APPLICATION

This application is a continuation-in-part of and claims priority from U.S. nonprovisional patent application Ser. No. 11/365,071 filed Feb. 28, 2006. The foregoing application is incorporated in its entirety herein by reference.

FIELD OF THE INVENTION

The present invention relates to foldable cards and more specifically to foldable cards that can expand and provide additional surface area for the presentation of information that can be printed thereon.

BACKGROUND

Foldable objects provide individuals with apparatuses that can provide additional information compared to those that are simply two-sided with only a single leaf. Conventional examples of such foldable objects include booklets and pamphlets that include a plurality of longitudinal panels enclosed by an outer cover.

Business cards are used by people and businesses to provide name and contact information to others. Some business card users may wish to include more information on a business card than what can typically be supplied on a conventional two-sided, single leaf business card. Other card format informational items such as medical cards, invitation cards, place settings, and gift cards are also used to provide information that is readily accessible but often lack a sufficient amount of space or material on which information can be printed due to the nearly universal use of two-sided, single leaf cards.

A foldable multi-leaf card is needed that can be configured in folded and expanded configurations to provide more information to the card holder than is possible using conventional single-leaf cards while still being sized and shaped so as to be readily portable in a pocket or wallet.

SUMMARY

The invention relates to a foldable card that can feature a plurality of leafs. Each leaf may have information printed or affixed thereon. The foldable card can be manipulated to configure it into folded or collapsed and open configurations. The plurality of leafs of the foldable card can be folded to conceal one or more of the leafs. When folded into its collapsed configuration, the foldable card can be sized and shaped to easily fit or insert into a wallet, pocket or other personal means of carrying the card such as, for example, a purse or business card carrier or case. The foldable card can be unfolded into its open configuration so as to reveal the leafs that were concealed when the foldable card was folded into its collapsed configuration.

The foldable card can be created for use as any of a number of objects that are used to store and transmit information from person to person or from a person to a company. For example, the foldable card can be used as a business card, a gift card, a medical card, or a place setting.

In one embodiment, the foldable card is an expandable business card that features a first page having a fold that joins two panels (or leafs). The first panel can include a detachable portion. The second panel can include a projection. The first page further includes an inner side and an outer side. The business card also includes a second page having four sides and three panels joined by two folds. A slot is defined in one of the folds. The second page has an inner side and an outer side. The outer side of the second page is connected to the inner side of the first page. A booklet is attached to the inner side of the second page. The business card has a closed first position in which the first panel of the second page is a cover and the detachable portion is a business card. The third panel of the second page is an opposed cover. The projection is at least partially concealed. A second position of the expandable business card includes the covers opened to show the booklet and the projection.

The second page has a first panel positioned under the first panel of the first page and includes a business card. The expandable business card in the second position includes the projection extending through the slot in the fold of the second page. The projection has two opposed sides and at least one of the sides of the projection can include text, an image, and a graphic.

The booklet in the second position includes two viewable panels and is positioned inside the perimeter of a first panel and a second panel of the second page. The booklet can expand to a third position that includes four viewable panels. The booklet can expand to a fourth position that includes eight viewable panels. The expandable business card includes a second cover opposite the first cover that can function as a cover for the booklet.

In another embodiment, the expandable business card comprises a first page that includes a first panel detachable from a second panel along perforations. A fold joins the second panel and a third panel. The third panel projects from the second panel. The first page has an inner side and an outer side. A second page includes three panels joined by two folds. A slot is defined in one of the folds. The second page has an inner side and an outer side. The outer side of the second page is connected to the inner side of the first page. A booklet is connected to the inner side of the second page. A first position of the expandable business card includes the expandable business card in a closed position. The first panel of the second page is a cover that includes, for example, a detachable business card. The third panel of the second page is the opposed cover for the booklet. The projection and the booklet are at least partially concealed in the first closed position. A second position includes the covers in an opened position to view the, at least partially, unfolded booklet. At least a portion of the third panel extends through the slot in the fold of the second page and is viewable. The booklet is positioned within the outer edges of the first panel and second panel of the second page. A third position wherein the booklet unfolds such that at least a portion of the booklet extends beyond the edges of the second page.

The expandable business card of claim wherein the booklet unfolds into a fourth position that is greater than the size of the second position. The expandable business card can have a height of about 3.5 inches when viewed as booklet. The expandable business card can have a width of about 2.9 inches when viewed as a booklet. The expandable business card can have a depth of about 0.1 inch.

Accordingly, the invention features an expandable card form that can include a plurality of leafs arranged and connected linearly, a projecting panel, and a slot. Each adjacent pair of leafs can be separated by a fold line, and each leaf can be foldable onto its immediately adjacent leafs. The projecting panel can be extended and retracted through the slot, which can be cut between two adjacent leafs, as the card is opened and closed. The card form forms a foldable card when assembled.

In another aspect, the invention can feature the foldable card being a business card.

In another aspect, the invention can feature the foldable card being a medical information card.

In another aspect, the invention can feature the foldable card being a place setting card.

In another aspect, the invention can feature the foldable card being a gift card.

The invention also features an expandable business card apparatus that can include a first page having an inner side and an outer side, a second page comprising an inner side and an outer side, and a booklet attached to the inner side of the second page. The first page can feature (i) a first panel having a detachable portion; (ii) a second panel detachably joined by perforations to the first panel; and (iii) a third panel having a projection and joined by a first fold to the second panel. The second page can feature a first panel joined by a second fold to a second panel and the second panel being joined by a third fold to a third panel. The third fold can include a slot. The inner side of the first page and the outer side of the second page can be attached by a connection that retains the first fold and the second fold at a predetermined distance to enable the extension and retraction of the projection through the slot.

In another aspect, the invention can feature the business card apparatus being configurable into a closed position and an open position.

In another aspect, the invention can feature the third panel of the second page including a cover and the first panel of the first page being an opposed cover when the business card apparatus is configured in the closed position.

In another aspect, the invention can feature the second page including a detachable business card that is formed by a panel selected from among the first panel and the third panel of the second page.

In another aspect, the invention can feature the projection being retractable into the slot and being at least partially concealed when the business card apparatus is configured in the closed position.

In another aspect, the invention can feature the projection being extendable out of the slot and the booklet being revealed when the business card apparatus is configured in the open position.

In another aspect, the invention can feature the first panel of the first page and the first panel of the second page can be attached by the connection.

In another aspect, the invention can feature the projection including two sides. At least one of the sides of the projection can include at least one of text, an image or a graphic.

The invention also features a business card that can include a first trifold sheet, a second trifold sheet, and a booklet attached to an inner side of the second trifold sheet. The first trifold sheet can feature three panels, one of which can include a projection. The second trifold sheet can feature three panels and can be attached to the first trifold sheet by a connection. A slot defined between two of the three panels of the second trifold sheet. The business card can further include an open configuration and a closed configuration. The projection can be retracted when the business card is oriented in the closed configuration and can be extended when the business card is oriented in the open configuration.

In another aspect, the invention can feature the booklet and projection including printed information selected from among at least one of text, graphics, and images. The printed information can be revealed when the business card is manipulated into the open configuration.

In another aspect, the invention can feature the three panels of the first trifold sheet including a first panel, a second panel and a third panel. The three panels of the second trifold sheet can also include a first panel, a second panel and a third panel.

In another aspect, the invention can feature the first panel and second panel of the first trifold sheet being separated by a first fold, the second panel and third panel of the first trifold sheet being separated by a second fold, the first panel and second panel of the second trifold sheet being separated by a third fold, and the second panel and third panel of the second trifold sheet being separated by a fourth fold.

In another aspect, the invention can feature the first panel of the first trifold sheet and first panel of the second trifold sheet being aligned and attached by the connection on and around where the third fold contacts the first panel of the first trifold sheet.

In another aspect, the invention can feature the third panel and the projection of the first trifold sheet being slidably disposed between the second panel and the third panel of the second trifold sheet. The second panel and the third panel of the second trifold sheet are rotatable at the connection and fourth fold so that the business card can be positioned in the open configuration or closed configuration. As the second panel and the third panel of the second trifold sheet are rotated to position the business card in the open configuration, the third panel of the first trifold sheet, the projection and the second fold are slidably movable toward the slot defined between the second panel and the third panel of the second trifold sheet so that the projection extends out of the slot between the second panel and the third panel of the second trifold sheet when the business card is positioned in the opened configuration.

In another aspect, the invention can feature the first panel and the second panel of the first trifold sheet including a single unfolded panel separated by perforations.

Unless otherwise defined, all technical terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents and other references mentioned herein are incorporated by reference in their entirety. In the case of conflict, the present specification, including definitions will control.

DETAILED DESCRIPTION

Figure 1:
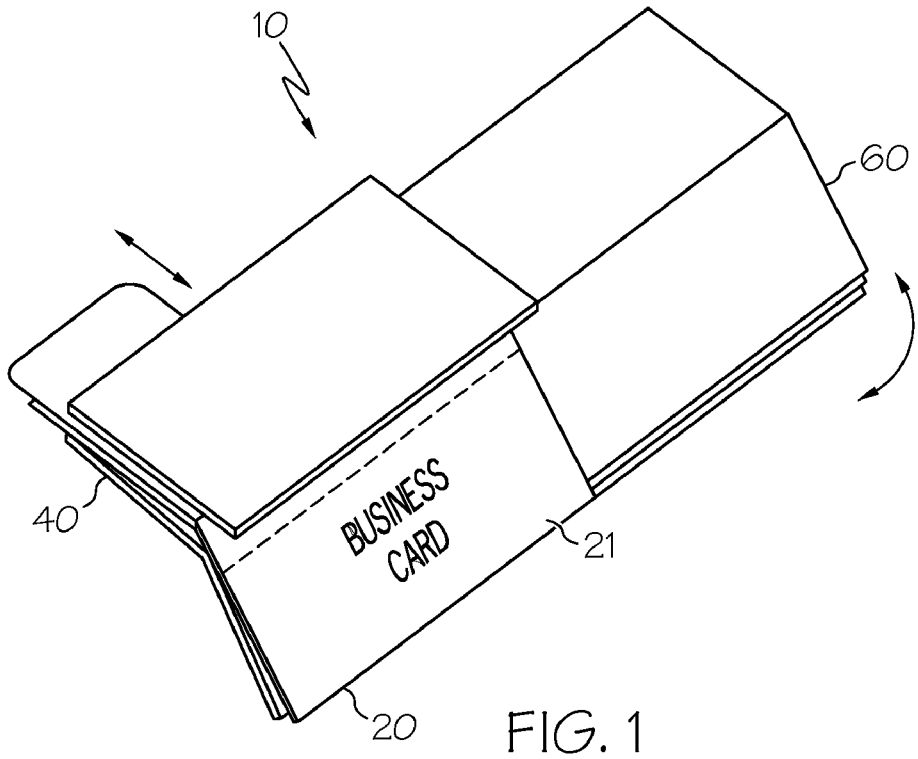
FIG. 1 is a top frontal perspective view of an expandable business card of the present disclosure.

Referring to FIG. 1, one embodiment of an expandable business card 10 includes a first page 20, a second page 40 and a booklet 60. First page 20 and second page 40 are connected and interrelated. Booklet 60 is connected to second page 40. Expandable business card 10 can advantageously expand to provide additional surface areas for the positioning of images, graphics, and/or trademarks associated with the cardholder and/or the cardholder's business.

Figure 2:
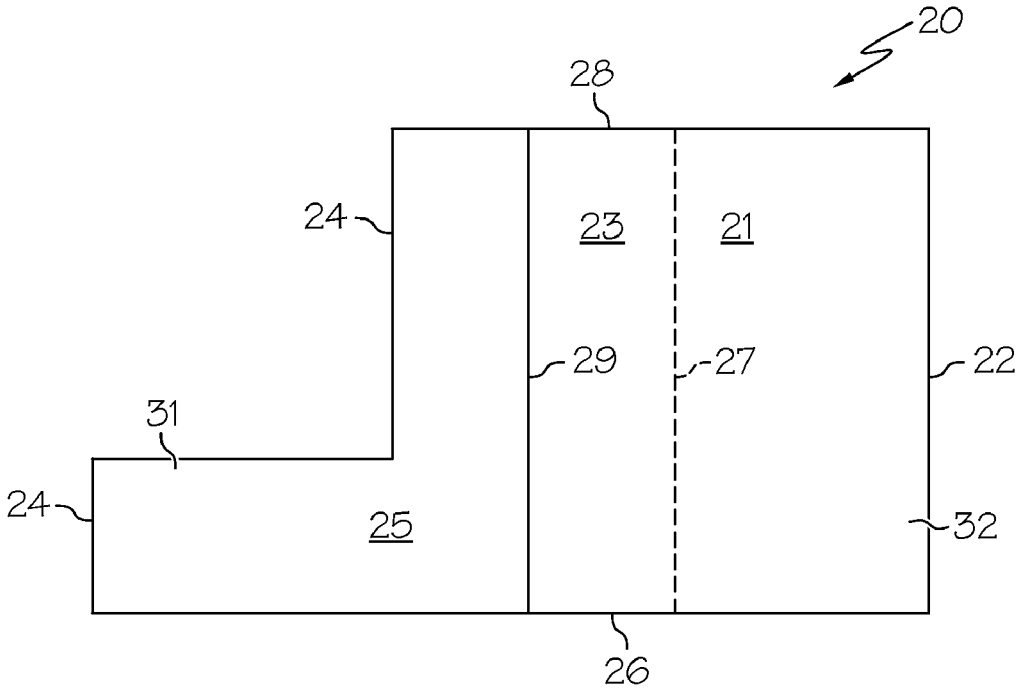
FIG. 2 is a plan view of a first page of the expandable business card of FIG. 1.

As shown in FIG. 2, first page 20 has a first edge 22 opposed by a second edge 24 and a third edge 26 opposed by a fourth edge 28. First page 20 includes a first panel 21, a second panel 23 and a third panel 25. First panel 21 and second panel 23 can be separated by perforations 27. First panel 21 can be a business card that can be readily separated from second panel 23 by tearing along perforations 23. The bottom of the business card includes edge 22 and the sides include a portion of opposed edges 26 and 28.

Third panel 25 is connected to second panel 23 by a fold 29. The second panel includes a projection 31. The terminal end of projection 31 includes an outer portion of second edge 24 that forms a corner with edge 26. Second edge 24 has an inner portion that forms a corner with edge 28 and is connected to projection 31. In this embodiment, first edge 22, second edge 24, perforations 23 and fold 29 are approximately parallel. First page 20 has a first side 32 opposed by a second side 34 (See FIG. 4).

Figure 3:
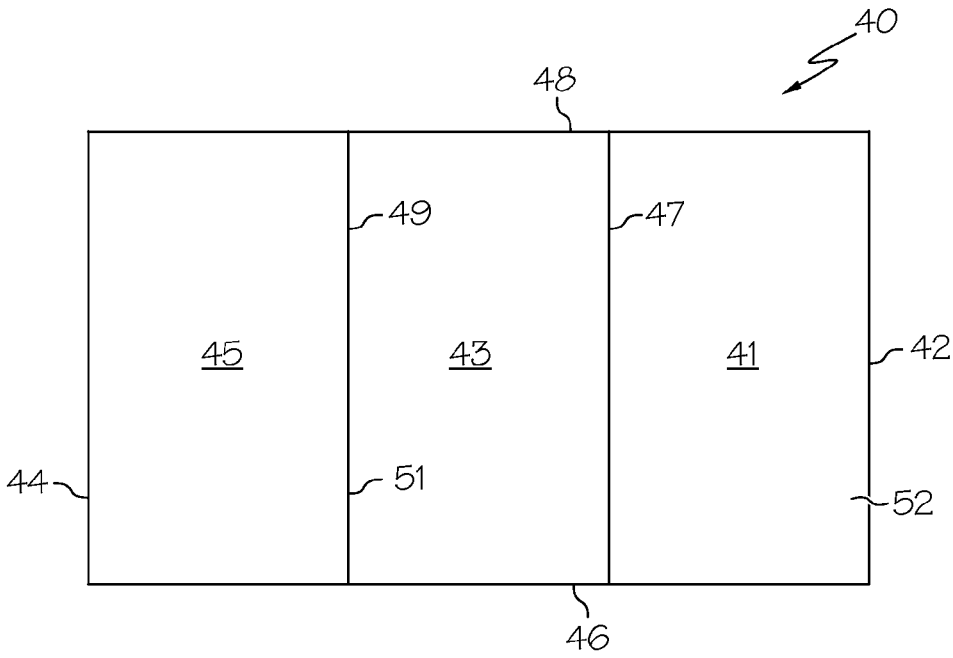
FIG. 3 is a plan view of a second page of the expandable business card of FIG. 1.

Referring now to FIG. 3, second page 40 includes a first edge 42 opposed by a second edge 44 and a third edge 46 opposed by a fourth edge 48. Second page 40 has a first panel 41, a second panel 43 and a third panel 45. A first fold 47 separates the first panel 41 and the second panel 43. A second fold 49 separates the second panel 43 and third panel 45. First panel 41 can include a detachable or non-detachable business card.

In an exemplary embodiment, first fold 47 includes a slot 51. Slot 51 can be a cut along a portion of fold 47 that can run a predetermined distance in an inward direction from edge 46 or a hole in portions of panels 43 and/or 45. As required, fold 47 can also include reinforcing to ensure the long term integrity of the connection of panels 41 and 43. Second page 40 also includes an outer side 52 and an inner side 54 (See FIG. 4).

In an exemplary embodiment, edges 26 and 28 and 46 and 48 are approximately parallel and have a fixed dimensional distance between the respective edges such that edges 26 and 46 and 28 and 48 can be aligned. Similarly, edges 22 and 42 and edges 24 and 44 are parallel and edges 22 and 42 and edges 24 and 44 can each be aligned to form a single combined edge.

Figure 4:
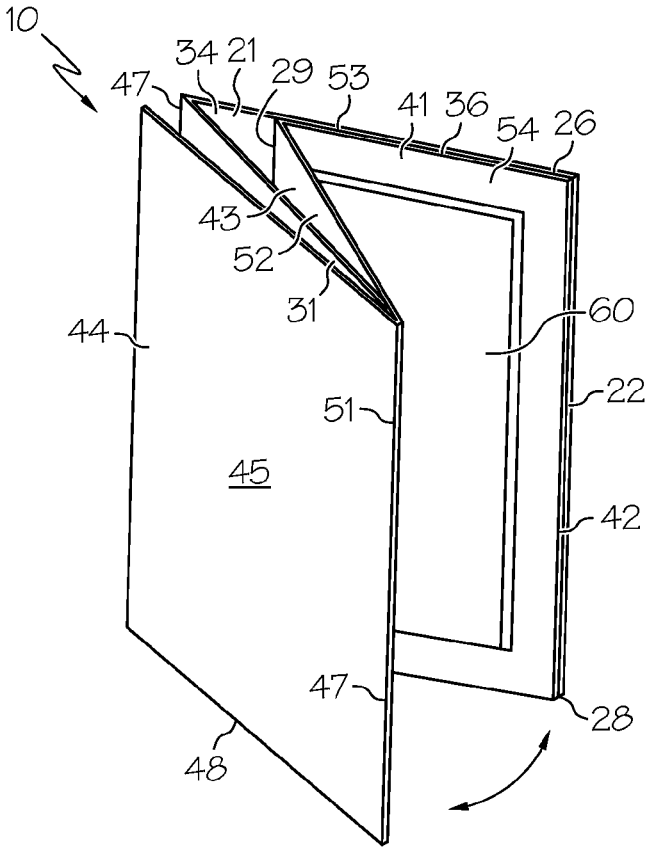
FIG. 4 is a top rear perspective view of a first page of the expandable business card of FIG. 1.

As shown in FIG. 4, expandable business card 10 is in a partially open position in which booklet 60 is folded and/or unexpended within the perimeter of pages 20 and 40. Business card 10 has a first unexpended position in which fold 47 and edges 41 and 21 are in close proximity and edge 44 is in apposition with fold 47. Card 10, as shown, has edges 28 and 48 directed downward such that card 10 is positioned like a miniature book. Portions of second sides 34 and 44 of first page 20 and second page 40 are viewable in this position. Projection 51 is partially hidden from view between first side 42 of panels 43 and 45.

Expandable business card 10 in this embodiment can have dimensions that are approximately 3.5 inches in height, approximately 2.875 inches in width, and approximately 0.125 inches in depth when fully folded and unexpended. It is understood that the external dimensions of expandable business card 10 can vary depending upon the desired application, but is intended to be sized such that it can easily carried in a wallet, purse or pocket. Expandable business card 10 can be made of paper or paper based products, but can also include plastics or composite materials. The folds of page 20, page 40 and booklet 60 can be pre-formed by flexible hinges or include a separate connecting hinge.

First side 42 and second side 34 can have a connection 53 made by an adhesive that extends in a line or strip approximately between edges 26, 36 and edges 28, 48. Connection 53 can be approximately parallel to and positioned in proximity to fold 47. Connection 53 places fold 47 and fold 29 at a predetermined fixed distance that functions to slidingly engage pages 20 and 40 to retract projection 31 in the folded or closed position and extend projection 31 in any of the expanded positions. Alternative methods for connecting include common fasteners such as staples, as well as heat bonding. Booklet 60 is attached to second side 44 of panels 41 and 43.

Figure 5:
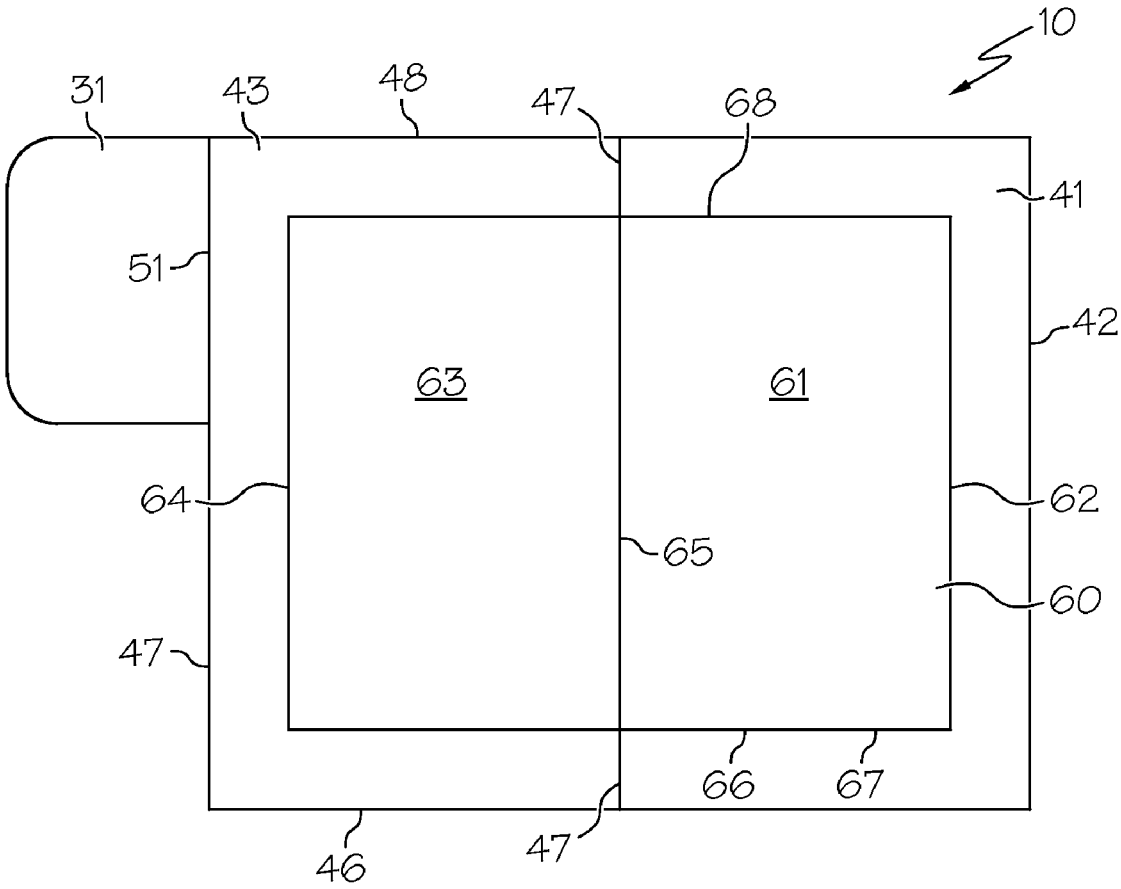
FIG. 5 is a plan view of the opened expandable business card of FIG. 1 in a first expanded position showing a booklet.

In operation, referring now to FIGS. 4 and 5, as expandable business card 10 is unfolded or expanded about fold 47, the fixed relationship of pages 20 and 40 and position of fold 29 relative to fold 47 and connection 53 extends projection 31 through slot 51. In this position at least a portion panel 45 and edge 44 extends over panel 41. As card 10 is moved into a first expanded position, panel 41, panel 43, booklet 60 and projection 31 are shown. Business card 10 unfolds or expands about connection 53 and fold 47.

Referring now to FIG. 5, booklet 60, in the first expanded position, includes a first side 62, an opposed second side 64, a third side 66, and an opposed fourth side 68. Booklet 60 in this position has two panels 61 and 63. A first fold 65 separates panels 61 and 63 and is aligned with fold 47. Side 64 includes a third fold 69. The opening of expandable business card 10 extends projection 31 through slot 51 and provides an eye catching additional viewable surface for an advertisement, image and/or trademark. The folded dimensions of booklet 60 in the first expanded position are less than that of edges 42, fold 47, edge 46 and edge 48 of second page 40.

Figure 6:
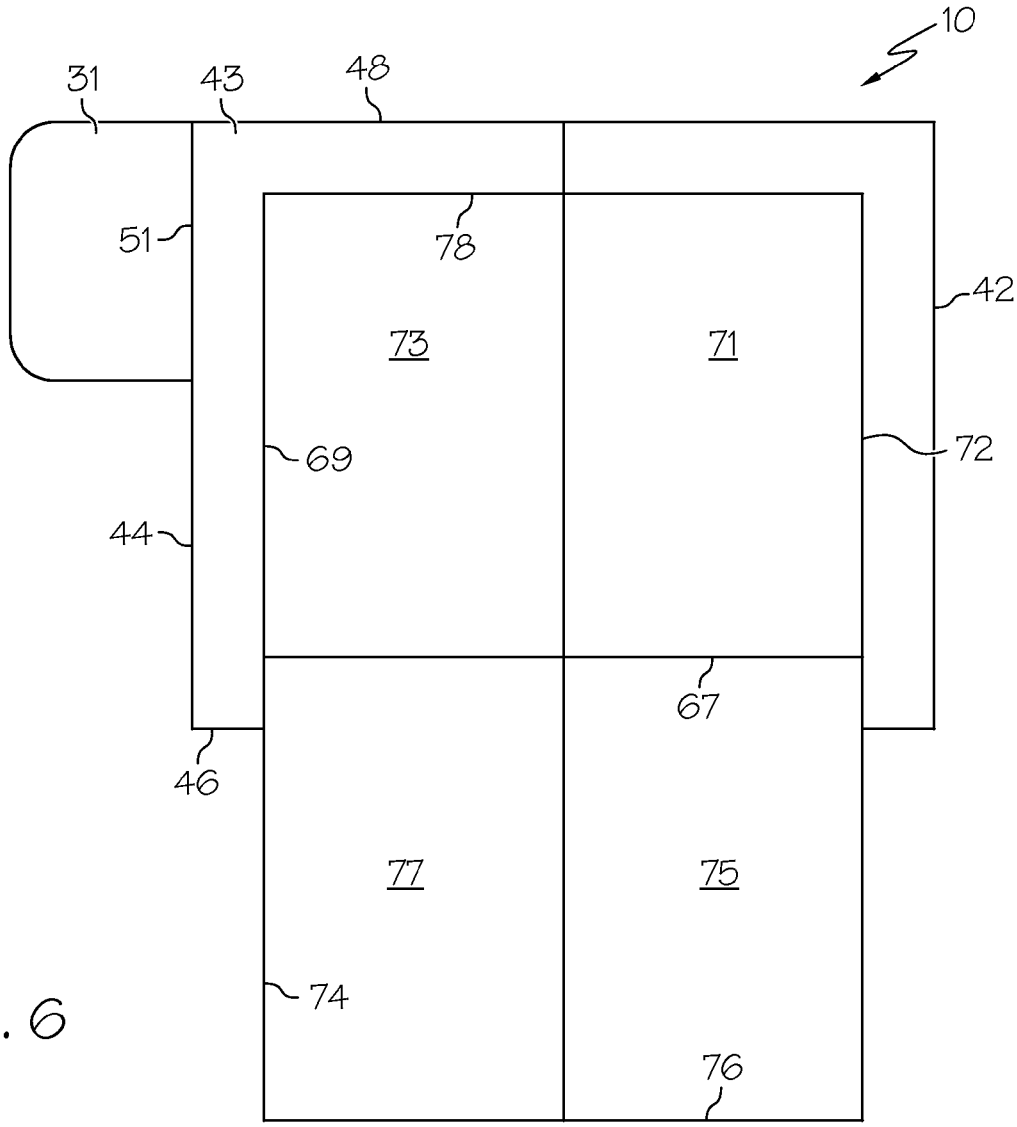
FIG. 6 is a plan view of the booklet of the expandable card of FIG. 5, in a second expanded position.

As shown in FIGS. 5 and 6, booklet 60 has unfolded and/or expanded into a second expanded position that includes unfolding along a fold 67 to show a first page of booklet 60 that has panels 71, 73, 75 and 77. The booklet 60 may contain up to thirty-two pages depending on the weight and thickness of the paper used. Booklet 60 in this second expanded position includes a first side 72, an opposed second side 74, a third side 76 and an opposed fourth side 78. Second fold 67 can be approximately parallel to edges 46 and 48 and can be either in proximity to edge 46 or edge 48. Panels 75 and 77 in this embodiment can extend beyond edge 46, but the remainder of booklet 60 can remain inside of edges 42, 44, and 48. Booklet 60 can also include a third fold 69 on side 64 that is now fully extended. This position provides a further expansion of surface area for text, images and advertising.

Figure 7:
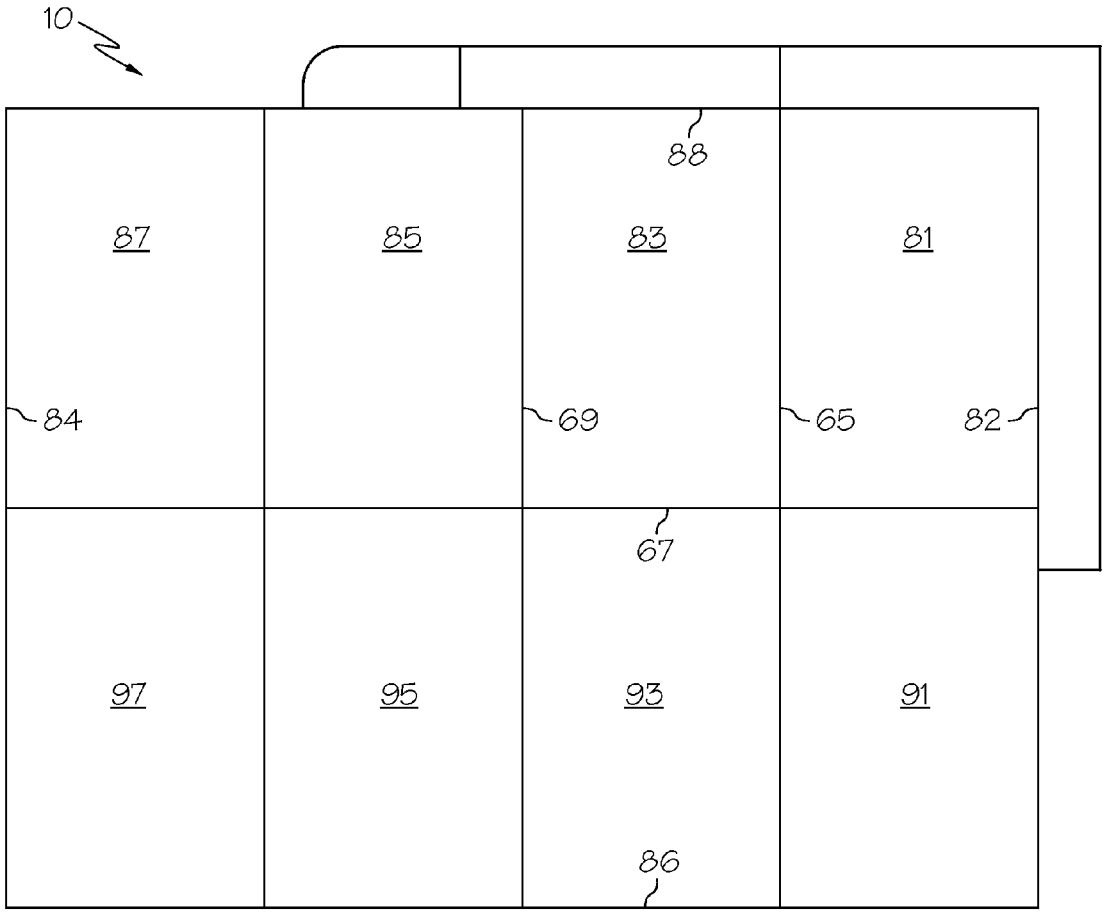
FIG. 7 is a plan view of the booklet of the expandable card of FIG. 5, in a third expanded position.

Referring now to FIGS. 6 and 7, booklet 60 has unfolded and/or expanded into a third expanded position that includes unfolding along fold 69 to show a third page of booklet 60 that has panels 81, 83, 85, 87, 91, 93, 95 and 97. Booklet 60 in this third expanded position includes a first side 82, an opposed second side 84, a third side 86 and an opposed fourth side 88. Booklet 60 can have a single page or multiple pages (up to thirty-two pages depending on the weight and thickness of the paper) each having one or more panels. In this third expanded position, booklet 60 extends beyond edges 44 and 46, but can remain inside of edges 42 and 48.

Expandable business card 10 is returned to the first unfolded position by folding booklet 60 about folds 69 and 67. Booklet 60 is then conveniently stored within the outer covers of expandable business card 10 and reduced to a convenient carrying size.

It is understood that while booklet 60 is described as having three positions for unfolding, booklet 60 can expand in a range from only the first expanded position to a plurality of expanded positions depending upon the desired application. Similarly, booklet 60 can include different quantities of folds that unfold or expand in differing directions that are also considered variations within the scope of the present disclosure.

In the preceding specification, the invention has been described with reference to specific exemplary embodiments thereof. It will however, be evident that various modifications, combinations and changes may be made thereto without departing from the broader spirit and scope of the invention as set forth in the claims that follow. For example, the external shape of expandable business card 10 can vary to provide a range of eye catching shapes and still retain the present functions. The specification and drawings are accordingly to be regarded in an illustrative manner rather than a restrictive sense.

Figure 8:
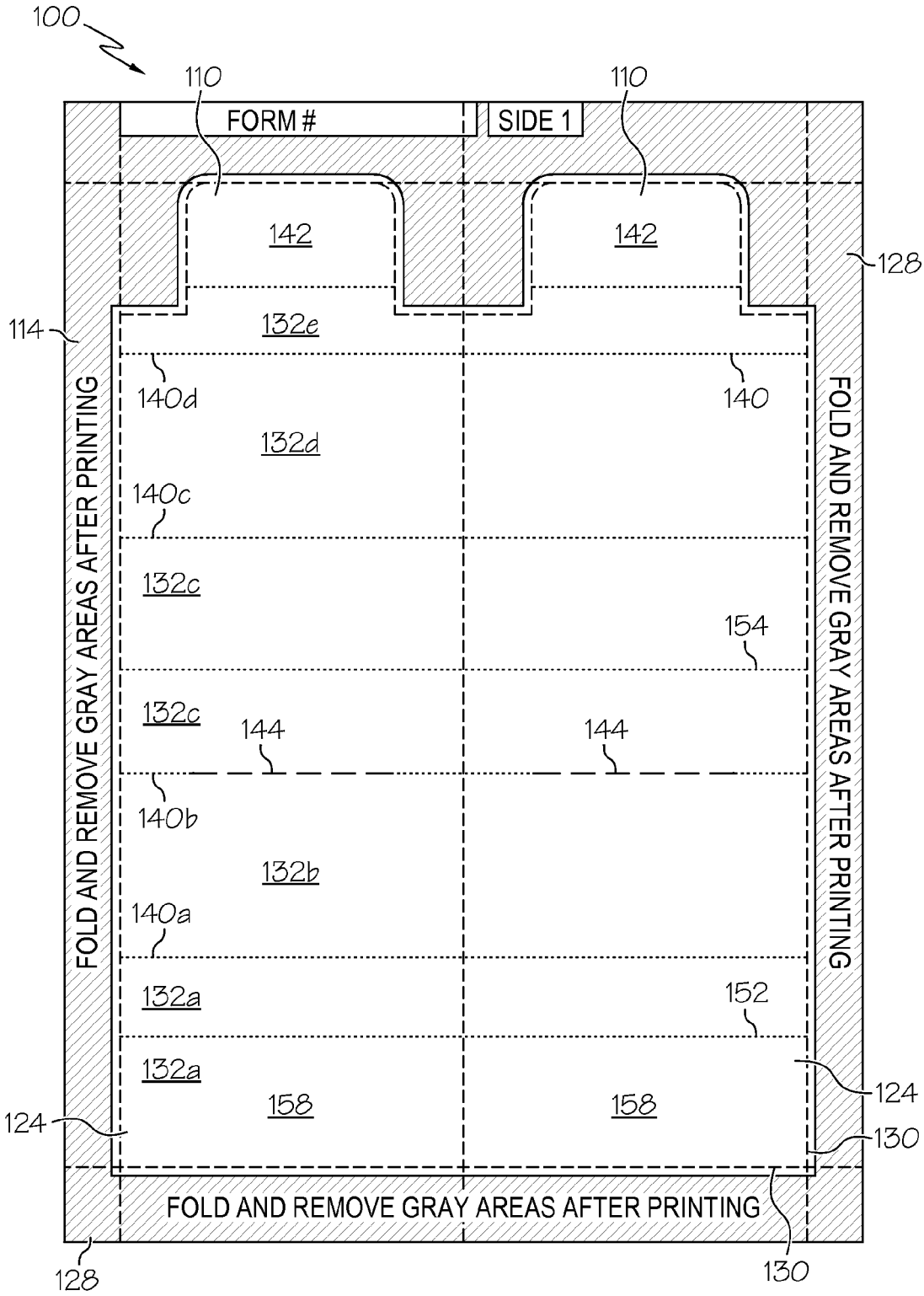
FIG. 8 is a planar view of a front surface of an expandable card form.
Figure 9:
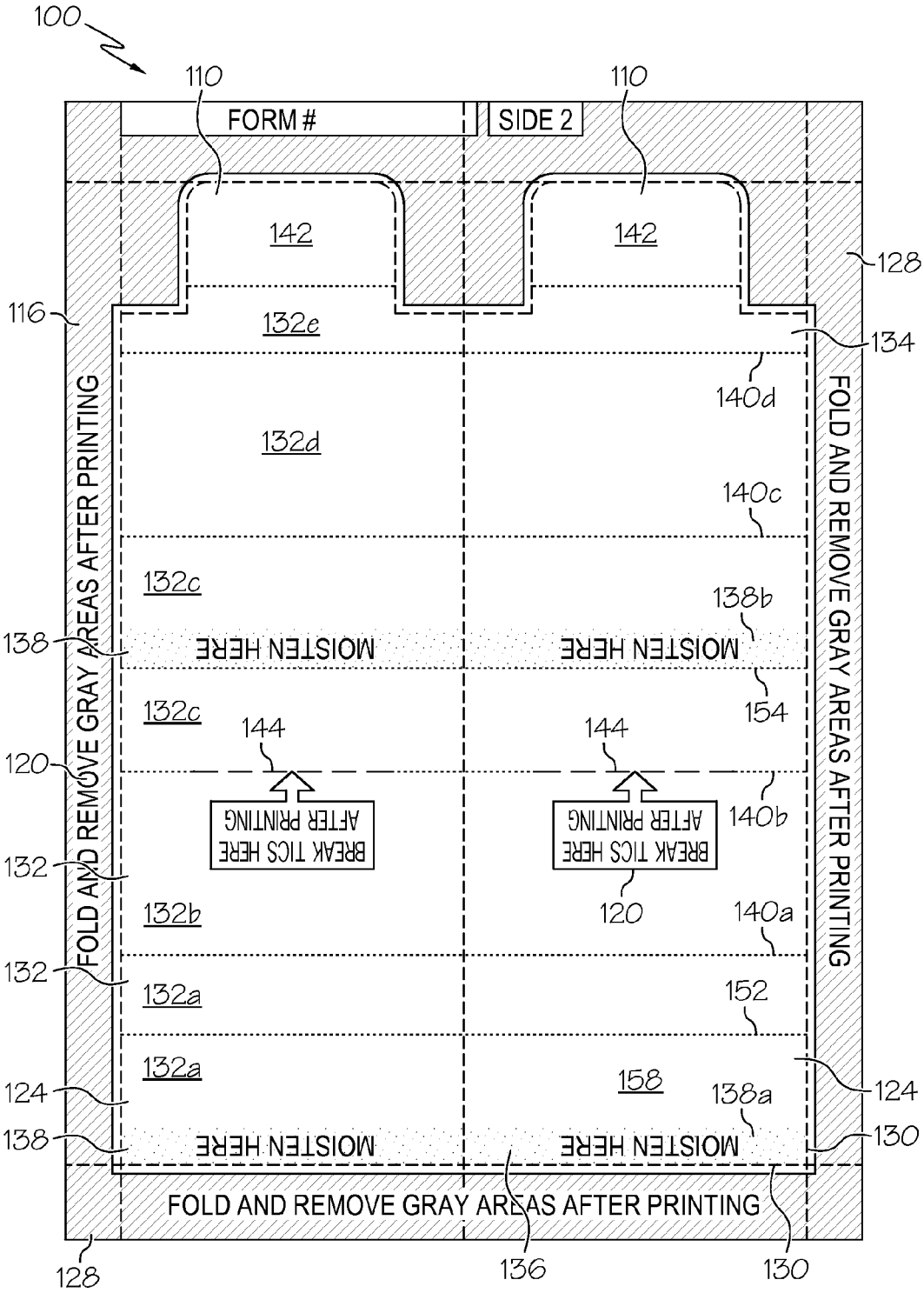
FIG. 9 is a planar view of a rear surface of the expandable card form of FIG. 8.
Figure 10:
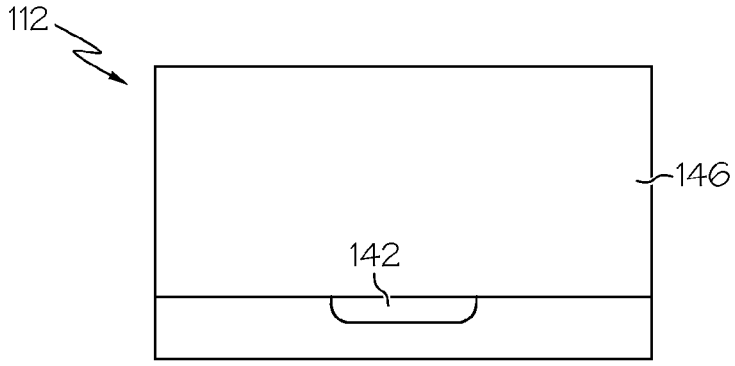
FIG. 10 is a perspective view of a closed foldable card created from an expandable card form.
Figure 11:
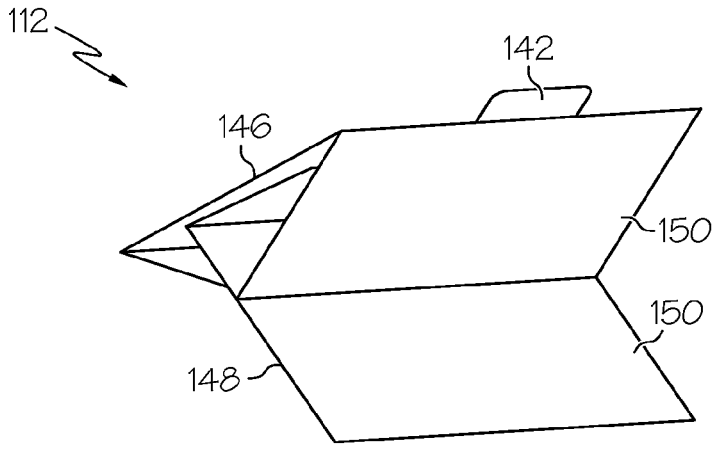
FIG. 11 is a perspective view of the foldable card of FIG. 10 now shown partially opened.
Figure 12:
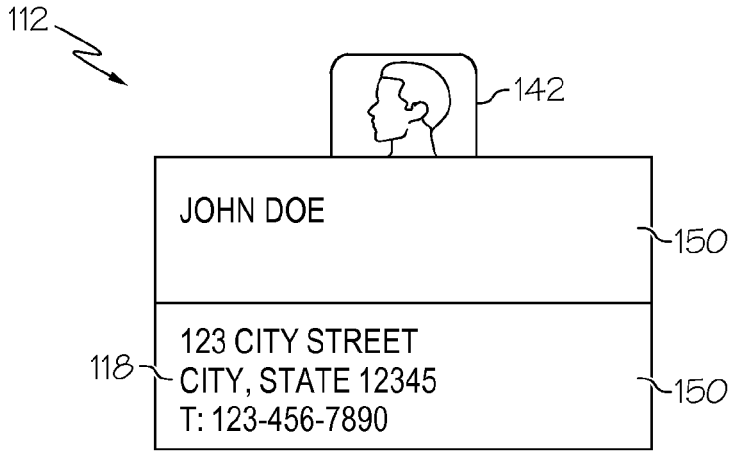
FIG. 12 is a perspective view of the foldable card of FIG. 10 now shown fully opened.

The invention also relates to a form 100 that includes an expandable card form 110 as shown in FIGS. 8 and 9. The expandable card form 110 can be folded and assembled to create a foldable card 112 such as the foldable card shown in FIGS. 10-12. The expandable card form 110 includes a front surface 114 and a rear surface 116. Information 118 as defined herein can be printed on both or either of the front and rear surfaces 114 and 116. In one embodiment, the front surface 114 of the expandable card form 110 can have information printed thereon and the rear surface 116 can have assembly instructions 120 printed thereon. When the expandable card form 110 is folded and assembled to create the foldable card 112, the surfaces of the leafs on which assembly instructions 120 are printed are not visible when the foldable card is in its open and closed configurations.

In one embodiment, the expandable card form 110 can be formed from a single sheet of material 122 such as paper or plastic. The sheet of material 122 can be any size or shape capable of being circulated through a printer for printing. The expandable card form 110 can form a detachable component 124 that may be detached from the sheet of material 122. In this embodiment, the sheet 122 that includes the detachable expandable card form 110 can be printed using any suitable printer or printing press. In some embodiments, the sheet of material 122 can include two or more expandable business card forms 110 as detachable components 124 made a part thereof. In an exemplary embodiment, the sheet of material 122 can be letter size and can include two expandable card forms 110 as detachable components 124.

In an exemplary embodiment, the sheet of material 122 can be a single ply. In other embodiments, the sheet of material 122 may feature two plies, three plies, four plies, or more of the material. In multi-ply embodiments of the expandable card form, each ply can be constructed from the same material as the other plies or from a different material. For example, in a two-ply expandable card form, one ply could be paper while the other could be plastic or foil.

As a detachable component, the sheet of material 122 incorporating the expandable card form 110 can include a frame 128 from which the card form can be detached after printing. The sheet of material 122 can include lines of separation 130 or perforations 130 to permit the expandable card form 110 to be cut or torn, removed and separated from the sheet of material, its frame, and from any other expandable business cards to which the form being detached happens to be attached. The frame 128 generally becomes waste material that must be removed from edges of the unassembled foldable card in order to detach the card from the frame. The frame 128 may be colored, e.g., gray, to clearly indicate the portions of the expandable card form that must be cut, torn, or otherwise detached and removed from the unassembled foldable card. In other embodiments, the sheet of material may not include a frame.

The expandable card form 110 can be assembled by folding into a foldable card 112 that is shaped and sized so as to be capable of insertion and storage in a wallet, a purse, a business card holder, a pocket, or any other suitable storage means. The expandable card form 110 can feature a plurality of foldable leafs 132 that may be manually or otherwise folded onto one another to create the foldable card 112. The plurality of leafs 132 can be arranged and connected linearly so that each adjacent leaf is connected to at least one other leaf. Each pair of adjoining leafs can be separated by a fold line 140. The expandable card form 110 can feature four, five, six or more leafs 132 including a first end leaf 134 and a second end leaf 136. The surfaces of the leafs 132 may feature areas of adhesive 138 that can be used to adhere or glue leafs together to assemble the foldable card 112 from the expandable card form 110. In exemplary embodiments, the adhesive areas 138 are affixed to the rear surface 116 of the expandable card form 110 so as to be on the same surface as the printed assembly instructions 120, which are concealed when a foldable card 112 is assembled from the expandable card form 110. The adhesive can be pressure-sensitive, remoistenable, or any other type of adhesive suitable for attaching surfaces of the leafs 132 together. Some leafs 132 of the expandable card form 110 may include fold lines 140 in addition to the fold lines that separate adjacent leafs. The leafs 132 can be identical in width and may be identical in height. In some embodiments, fold lines 140 separating each adjacent pair of leafs may divide the expandable card form 110 into leafs of differing heights.

The expandable card form 110 can further include a projecting panel 142 and a slot 144. Each adjacent pair of leafs 132 can be separated by a fold line 140, and each leaf can be foldable onto its immediately adjacent leafs. The projecting panel 142 can be physically connected to the second end leaf. In another embodiment, the second end leaf can be cut and shaped so as to form the projecting panel 142. The projecting panel 142 can be extended and retracted through the slot 144, which can be cut between two adjacent leafs, as the card 112 is opened and closed.

The slot 144 can be cut or otherwise formed between two adjoining leafs 132 of the expandable card form 110. The plurality of leafs 132 can be folded during assembly of the foldable card 112 so that when the foldable card is folded into its open configuration the projecting panel 142 slides through the slot 144 and extends out of the card for viewing by the user. The information 118 printed on the projecting panel 142 is visible to the user when the foldable card 112 is oriented in its open configuration. When the foldable card 112 is folded closed for storage, the projecting panel 142 is retracted into an interior of the card so as not to be visible to the user.

The foldable card 112 includes a front outer surface 146 and a rear outer surface 148 as well as an inner surface 150. Information 118 as defined herein can be printed on the front and rear outer surfaces 146 and 148 and on the inner surface 150 of the foldable card 112 prior to its assembly from the expandable card form 110. When the card 112 is placed in its open configuration the inner surface 150 and the information 118 printed thereon is revealed and is visible to the user. When the card is placed in its closed configuration, the inner surface and the information printed on the inner surface are concealed and only the front and rear outer surfaces are visible to the user.

In one embodiment, a booklet comprising one or more additional sheets of material featuring a plurality of folded leafs can be attached by an adhesive, staple or other fastener to the inner surface of the foldable card. The booklet can provide additional surfaces on which information can be printed that the user wishes to deliver or make available to recipients of the foldable card, i.e., persons to whom the foldable cards are given.

Information such as text, images, symbols, or other graphics can be preprinted on the expandable card form, partially preprinted on the expandable card form, or not preprinted on the expandable card form. Where the information is only partially preprinted or not printed at all on the expandable card form, the user or consumer can use any suitable printer to print information on the form to customize it for use by the user or another person or entity.

In an exemplary embodiment, the foldable card can be a business card. The business card can have the company name, address, telephone number, website address, or other contact information printed thereon. The user's name and direct contact information for the individual user may also be printed on the business card as with traditional business cards. The foldable card can also include information printed thereon concerning the company or user's goods or services. For example, a product list and price list might be printed on one or more of the plurality of leafs. A photograph of the user may be printed on the projecting panel.

In another embodiment, the foldable card can be a place setting card, e.g., of the type used to designate seating assignments at a wedding, seminar, or other event. The place setting card can have information printed thereon such as, for example, the invitee's name, information concerning the event being attended, or advertisements where the event is a seminar.

In another embodiment, the foldable card can be a medical information card. The medical information card can include information related to the user's medical conditions, treatments, allergies, medications, physician contact information, and emergency contact information.

In another embodiment, the foldable card can be a gift card. The gift card can have printed thereon a gift representation that visually represents a gift item, the amount of funds available to the recipient of the gift card, advertisements, and a bar code or gift card number. Manufacturer and retailer information, information related to the gift, information related to other products or information, a register similar to a check register that can be used to track the amount of funds available on the gift card after purchases are made using it, and any other desired information may be printed on the gift card.

In all of these embodiments, the information preprinted or printed by the user on the foldable card can be relevant to the card's intended purpose, e.g., business name and contact information on a business card, seminar information on a place setting card, and medical information on a medical information card. A photograph or other information may be printed on the projecting panel of the foldable card when it is to be used as a business card or place setting. In one embodiment of the place setting card, medical warnings such as drug allergies or information pertaining to the user's medical condition may be printed on the projecting panel.

In one embodiment of the gift card, a gift representation (e.g., a photograph of a gift item) may be printed on the projecting panel. The gift representation printed on the projecting panel would be revealed and visible to a gift recipient when the recipient of the gift card folds the card into its open configuration.

In an exemplary embodiment, the expandable card form can include a single, letter-size sheet of paper that includes a frame and two detachable unassembled foldable cards that can be removed from the frame by tearing along lines of perforation formed at the edges of each unassembled foldable card.

In the exemplary embodiment described above, each detachable unassembled foldable card can feature five leafs, i.e., a first leaf, a second leaf, a third leaf, a fourth leaf, and a fifth leaf, that are arranged and connected linearly so that each pair of adjacent leafs is connected at a fold line. By way of example rather than for purposes of introducing any limitation, the following description is provided with reference to the parts of only one of the unassembled foldable cards of the exemplary expandable card form.

The first and fifth leafs are end leafs in that each is connected to only one adjoining leaf, i.e., the first leaf is connected only to the second leaf and the fifth leaf is connected only to the fourth leaf. The leafs are connected widthwise in a linear arrangement. The first leaf is connected to the second leaf at a first fold line. The second leaf is connected to the third leaf at a second fold line. The third leaf is connected to the fourth leaf at a third fold line. The fourth leaf is connected to the fifth leaf at a fourth fold line.

The first leaf can include a first surface fold line positioned horizontally at a location about two-thirds of the height of the first leaf. The third leaf can include a second surface fold line positioned horizontally at a location about one-third of the height of the third leaf. The second and fourth leafs of the unassembled foldable card do not include additional fold lines, e.g., surface fold lines formed in the surface of a leaf, other than the fold lines separating them from their adjoining leafs.

The first, second, third and fourth leafs are generally rectangular in shape and are shaped and sized similar to a conventional business card. The fifth leaf is cut to form the projecting panel. The projecting panel can be more narrow than the remainder of the fifth leaf and can be rectangular or oblong in shape although other geometrical and irregular shapes are also contemplated by the invention. The projecting panel can be formed by cutting or tearing at lines of perforation the excess material of the fifth leaf that adjoins the projecting panel.

The slot is formed by a cut or perforations located on the second fold line that separates the second and third leafs. The slot is sized so to be capable of receiving the width of the projecting panel that is extended out of and retracted through the slot as the user manipulates the foldable card from open to closed configuration and vice versa.

The front surface of the unassembled foldable card includes a plurality of spaces on which information, as that term is defined herein, can be printed either during manufacturing or by the user using any suitable printing device before detachment of the unassembled foldable card from the expandable card form sheet. The rear surface includes assembly instructions printed thereon. A rear surface of the projecting panel includes information, e.g., a photograph of a user, printed thereon.

A bottom portion of the first leaf's rear surface includes a first adhesive area. The third leaf's rear surface includes a second adhesive area located above the second surface fold line.

Once the unassembled foldable card is detached from the expandable card form sheet, a method of assembling described below is used to assemble the exemplary embodiment of the expandable card form described above to create a fully assembled foldable card.

In a first step of the assembly method, the unassembled foldable card is folded at the second surface fold line so that the front surfaces of first and second leafs and a bottom portion of the third leaf's front surface are folded onto and in contact with the front surfaces of the fourth and fifth leafs and the front surface of a top portion of the third leaf's front surface.

In a second step of the assembly method, holding the folded top and bottom portions of the third leaf, the fourth and fifth leafs are then folded at the third fold line toward so that the fourth leafs rear surface is folded onto and in contact with the top portion of the third leaf's rear surface. The second adhesive area of the third leafs rear surface secures the fourth leaf's rear surface to the third leaf's rear surface.

In a third step of the assembly method, the fifth leaf is folded onto the fourth leaf at the fourth fold line so that the rear surfaces of the fourth and fifth leafs are in contact. While the rear surface of the fifth leaf contacts the fourth leaf's rear surface, the fifth leaf's front surface is exposed and faces upward so as to be visible to the user when this step has been completed.

In the fourth step of the assembly method, the projecting panel is inserted through the slot on the second fold line. The slot may need to be opened during this step if it has not been previously cut or its perforations previously torn to form the slot aperture.

In the fourth step of the assembly method, the first and second leafs are folded at the second fold line so that the second leaf's rear surface is placed in contact with the bottom portion of the third leaf's rear surface and the exposed portion of the fifth leafs front surface.

In the fifth step of the assembly method, the first leaf is folded at the first fold line so that its rear surface is attached by the first adhesive area to the front surface of the fourth leaf. This step completes the assembly of the unassembled foldable card into an assembled foldable card that can be distributed to others for the purpose intended by the user. As this step of the assembly method is completed, the foldable card is oriented in the closed configuration. The first leafs front surface forms the rear outer surface of the assembled foldable card, and the second leaf's front surface forms the front outer surface of the card.

Grasping a rear portion of the assembled foldable card, which is formed by the first and fourth leafs and the top portion of the third leaf, a front portion of the foldable card can be pivoted upward and away from the foldable card's rear portion to place the foldable card into its open configuration. Folding the foldable card from its closed configuration into its open configuration folds the front portion of the card rearward by folding the top portion of the first leaf onto the bottom portion of the first leaf at the first surface fold line. The front portion of the foldable card is formed by the second leaf and the bottom portion of the third leaf. The inner surface of the foldable card is formed by the top and bottom portions of the third leaf.

During this transitional movement, the first leaf's bottom portion is held securely in position by the attachment of its first adhesive area to the fourth leafs front surface. Similarly, the third leaf's top portion is held securely in position during the configuration-changing transitional movement by its attachment to the fourth leafs rear surface. When oriented in its closed configuration, the fourth fold line is inserted into the fold formed at the first fold line. When closed, the slot is oriented downward at a bottom of the foldable card's front portion. The fourth and fifth leafs are also folded together at the fourth fold line when the foldable card is in the closed configuration.

As the foldable card's top portion is pivoted upward into the open configuration, the fourth leaf is held stationary by its aforementioned attachments to the first and third leafs at the first and second adhesive areas. The first and second surface fold lines create a hinge on both sides of the immovable fourth leaf whereby the foldable card's front portion (i.e., the second leaf) is rotatable from its closed position over top of a surface at which the fourth and fifth leafs are adjoined at the fourth fold line and rearward so as to be positioned in parallel with but facing away from the foldable card's rear portion (i.e., the first leaf and its front surface). Being adjoined to the fourth leaf, when the foldable card's front portion is pivoted upward and rearward in the rotational movement, the fifth leaf is forced to slide across the second leafs rear surface as the rotational movement opens the previously folded fourth fold line. As the fourth and fifth leafs are unfolded at the fourth fold line, the projecting panel of the fifth panel is forced through the slot so as to reveal the projecting panel and any information printed thereon to the user. The foldable card's front portion is folded upward and forward to reorient the foldable card from its open configuration into its closed configuration.

While the card is in its open configuration, a bottom edge of the foldable card's rear portion and a top edge of the foldable card's top portion can act as leg or support members to arrange the foldable card in a generally vertical and open orientation when placed on a horizontal surface such as a table or desk.

Indicia such as sets of numbers or letters or both, symbols, and directional arrows may be printed on the rear surface of the expandable card form to assist the user in assembling the expandable card form into a foldable card once the form has been detached from the sheet of material and after any information desired to be printed thereon has been imprinted on the foldable card. For convenience and ease of use, information can be printed on the expandable card form sheet of material before the unassembled foldable card is detached therefrom. The fold lines and surface fold lines can include printed dotted or dashed lines to increase the visibility of each fold line or surface fold line.

Other Embodiments

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. An expandable business card apparatus that comprises:

a first page comprising an inner side and an outer side and further comprising:

(i) a first panel comprising a detachable portion;

(ii) a second panel detachably joined by perforations to the first panel; and (iii) a third panel comprising a projection and joined by a first fold to the second panel;

a second page comprising an inner side and an outer side and further comprising:

a first panel joined by a second fold to a second panel and the second panel joined by a third fold to a third panel, wherein the third fold comprises a slot, wherein the inner side of the first page and the outer side of the second page are attached by a connection that retains the first fold and the second fold at a predetermined distance to enable the extension and retraction of the projection through the slot; and a booklet attached to the inner side of the second page, wherein the projection is extended out of the slot and the booklet is revealed when the business card apparatus is configured in an open position.

2. The business card apparatus of claim 1, wherein the business card apparatus comprises a closed position and the open position.

3. The business card apparatus of claim 2, wherein in the closed position, the third panel of the second page comprises a cover and the first panel of the first page is an opposed cover.

4. The business card apparatus of claim 3, wherein the second page comprises a detachable business card that is formed by a panel selected from the group consisting of the first panel and the third panel of the second page.

5. The business card apparatus of claim 2, wherein the projection is retracted into the slot and is at least partially concealed when the business card apparatus is configured in the closed position.

6. The business card apparatus of claim 1, wherein the first panel of the first page and the first panel of the second page are attached by the connection.

7. The business card apparatus of claim 1, wherein the projection comprises two sides and at least one of the sides of the projection comprises at least one item selected from the group consisting of text, an image and a graphic.

* * * * *